US012576955B2

(12) United States Patent
Roth

(10) Patent No.: US 12,576,955 B2
(45) Date of Patent: Mar. 17, 2026

(54) MASS SHIFTING APPARATUS AND SYSTEM FOR INDUCING A VERTICAL DIVE IN SUBMERSIBLE CONVEYANCES

(71) Applicant: The United States of America as represented by the Secretary of the Navy, San Diego, CA (US)

(72) Inventor: Leif Erik Roth, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 459 days.

(21) Appl. No.: 18/303,824

(22) Filed: Apr. 20, 2023

(65) Prior Publication Data

US 2024/0351673 A1 Oct. 24, 2024

(51) Int. Cl.
*B63G 8/26* (2006.01)

(52) U.S. Cl.
CPC ..... *B63G 8/26* (2013.01)

(58) Field of Classification Search
CPC .... B63G 8/00; B63G 8/14; B63G 8/26; B63B 39/00; B63B 39/02; B63B 43/08; B63B 21/66; B63B 2207/00
USPC ..... 114/312, 313, 317, 330, 331, 121, 124
See application file for complete search history.

(56) References Cited

U.S. PATENT DOCUMENTS

| | | | | |
|---|---|---|---|---|
| 3,362,367 A * | 1/1968 | Rosfelder | ..... | B63G 8/26 114/330 |
| 4,455,962 A * | 6/1984 | Gongwer | ..... | B63B 3/13 114/61.3 |
| 5,018,472 A * | 5/1991 | Sullivan | ..... | B63G 8/42 114/244 |
| 10,661,623 B2 * | 5/2020 | Edwards | ..... | B63G 8/001 |

* cited by examiner

*Primary Examiner* — Daniel V Venne
(74) *Attorney, Agent, or Firm* — Naval Information Warfare Center Pacific; Kyle Eppele; J. Eric Anderson

(57) ABSTRACT

A mass shifting apparatus and system for inducing a vertical dive in submersible conveyances. Furthermore, an apparatus for inducing a submersible conveyance into a vertical dive, comprising a track, having a proximal end and distal end, defining a slide path wherein the track is fixed to an external surface of a submersible conveyance in alignment with a dive vector; a shifting weight operably engaged with the slide path to traverse between the proximal end and the distal end, wherein the shifting weight provides a balancing moment to the submersible conveyance when adjacent to the proximal end, and wherein driving the shifting weight towards the distal end provides dive moment to the submersible conveyance; and a means for driving the shifting weight along the slide path. In one embodiment, a modular apparatus for inducing a modular submersible conveyance into a vertical dive.

2 Claims, 4 Drawing Sheets

Fig. 1B

MASS SHIFTING APPARATUS AND SYSTEM FOR INDUCING A VERTICAL DIVE IN SUBMERSIBLE CONVEYANCES

STATEMENT REGARDING FEDERALLY-SPONSORED RESEARCH AND DEVELOPMENT

The United States Government has ownership rights in this invention. Licensing inquiries may be directed to Office of Research and Technical Applications Naval Information Warfare Center Pacific, Code 72120, San Diego, CA, 92152; telephone (619) 553-5118; email: niwc_patent.fct@us.navy.mil, referencing Navy Case 114, 403.

BACKGROUND

Submarines, unmanned underwater vehicles, and other submersible conveyances are commonly optimized for horizontal movement. Typical designs keep the center of buoyancy aligned vertically over the center of mass so that the body is at equilibrium while in the horizontal orientation. Once this body is rotated into a vertical orientation the mass and buoyancy are no longer vertically aligned resulting in a moment that destabilizes the body and requires a reaction moment from the control surfaces. Existing strategies to induce stable dive trajectories are inadequate solutions. These include attaching a droppable weight to the front of a submersible, pumping water in with ballast pumps, and spiraling downwards in helical paths. Attaching a droppable weight is insufficient because it is single-use and requires recovery of the weights. Moreover, releasing the weight causes a dramatic change in the submersible's overall buoyancy. Ballast pumps merely provide an energy intensive weighted dive, because the volume of water required to overcome the density of the craft is significant and the speed of intake is limited by the pump's flow rate. Additionally, the pumps may operate even slower when expelling water to an outside environment with high pressure. This makes the ballast sump systems slow to react to dynamic situations. Finally, helical paths are inefficient because you need more space, time, and energy to execute this movement pattern. Accordingly, there is a need for a system or apparatus to induce a vertical dive quickly, repeatedly, and efficiently.

SUMMARY

According to illustrative embodiments, an apparatus for inducing a submersible conveyance into a vertical dive, comprising a track, having a proximal end and distal end, defining a slide path wherein the track is fixed to an external surface of a submersible conveyance in alignment with a dive vector; a shifting weight operably engaged with the slide path to traverse between the proximal end and the distal end, wherein the shifting weight provides a balancing moment to the submersible conveyance when adjacent to the proximal end, and wherein driving the shifting weight towards the distal end provides dive moment to the submersible conveyance; and a means for driving the shifting weight along the slide path. Moreover, the apparatus for inducing a submersible conveyance into a vertical dive may further comprise a belt coil adjacent the proximal end of the slide path for coiling the belt; and a constrained belt, having a proximal end and distal end, wherein the proximal end is connected to the belt coil and the distal end is connected to the shifting weight. Moreover, the means for driving the shifting weight may be a direct drive belt feed wheel, rotary actuator, or cylindrical drum feed. Moreover, the apparatus for inducing a submersible conveyance into a vertical dive, wherein the means for driving the shifting weight along the slide path further comprises a plurality of motorized wheels, positioned between the shifting weight and the track, for operatively driving the shifting weight; or wherein the means for driving the shifting weight along the path is a linear motor, wherein the track is magnetized with magnets placed adjacent to the slide weight. Moreover, the apparatus for inducing a submersible conveyance into a vertical dive, wherein the submersible conveyance is an unmanned underwater aquatic vehicle.

Additionally, a modular apparatus for inducing a submersible conveyance into a vertical dive, comprising a modular track, having a proximal end and distal end, defining a slide path wherein the track is fixed to an external surface of a modular submersible conveyance in alignment with a dive vector a shifting weight operably engaged with the slide path to traverse between the proximal end and the distal end, wherein the shifting weight provides a balancing moment to the submersible conveyance when adjacent to the proximal end, and wherein driving the shifting weight towards the distal end provides dive moment to the submersible conveyance; and a means for driving the shifting weight along the slide path. Moreover, the modular apparatus for inducing a submersible conveyance into a vertical dive may further comprise a belt coil adjacent the proximal end of the slide path for coiling the belt; and a constrained belt, having a proximal end and distal end, wherein the proximal end is connected to the belt coil and the distal end is connected to the shifting weight. Moreover, the means for driving the shifting weight may be a direct drive belt feed wheel, rotary actuator, or cylindrical drum feed. Moreover, the modular apparatus for inducing a submersible conveyance into a vertical dive, wherein the means for driving the shifting weight along the slide path further comprises a plurality of motorized wheels, positioned between the shifting weight and the track, for operatively driving the shifting weight; or wherein the means for driving the shifting weight along the path is a linear motor, wherein the track is magnetized with magnets placed adjacent to the slide weight. Moreover, the modular apparatus for inducing a submersible conveyance into a vertical dive, wherein the submersible conveyance is an unmanned underwater aquatic vehicle.

Additionally, a submersible conveyance for vertical dives; comprising a submersible conveyance having an external surface; a track, having a proximal end and distal end, defining a slide path wherein the track is fixed to an external surface of a submersible conveyance in alignment with a dive vector; a shifting weight operably engaged with the slide path to traverse between the proximal end and the distal end, wherein the shifting weight provides a balancing moment to the submersible conveyance when adjacent to the proximal end, and wherein driving the shifting weight towards the distal end provides dive moment to the submersible conveyance; and a means for driving the shifting weight along the slide path. Moreover, the submersible conveyance for vertical dives may further comprise a belt coil adjacent the proximal end of the slide path for coiling the belt; and a constrained belt, having a proximal end and distal end, wherein the proximal end is connected to the belt coil and the distal end is connected to the shifting weight. Moreover, the submersible conveyance for vertical dives, wherein the means for driving the shifting weight along the slide path is a direct drive belt feed wheel, rotary actuator, or cylindrical drum feed. Moreover, the submersible conveyance for vertical dives, wherein the means for driving the shifting weight along the slide path further comprises a plurality of motorized wheels, positioned between the shifting weight and the track, for operatively driving the shifting weight. Moreover, the submersible conveyance for vertical dives, wherein the means for driving the shifting weight along the path is a linear motor, wherein the track is magnetized with magnets placed adjacent to the slide weight. Moreover, the submersible conveyance for vertical dives, wherein the track is modular, and wherein the submersible conveyance is modular.

It is an object to provide a mass shifting apparatus and system for inducing a vertical dive in submersible conveyances that offers numerous benefits, including allowing a submersible conveyance to enter a vertical dive without changing its buoyancy, or being affected by pressure. Additionally, submersible conveyances could be modular, having multiple sections that could interlock while maintain vertical dive capabilities.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The accompanying drawings, which are incorporated in and form a part of the specification, illustrate example embodiments and, together with the description, serve to explain the principles of the invention. Throughout the several views, like elements are referenced using like references. The elements in the figures are not drawn to scale and some dimensions are exaggerated for clarity. In the drawings.

DETAILED DESCRIPTION OF EMBODIMENTS

The disclosed system and apparatus below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other system and apparatus described herein as will be understood by one of ordinary skill in the art unless otherwise stated specifically.

References in the present disclosure to "one embodiment," "an embodiment," or any variation thereof, means that a particular element, feature, structure, or characteristic described in connection with the embodiments is included in at least one embodiment. The appearances of the phrases "in one embodiment," "in some embodiments," and "in other embodiments" in various places in the present disclosure are not necessarily all referring to the same embodiment or the same set of embodiments.

As used herein, the terms "comprises," "comprising," "includes," "including," "has," "having," or any variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of words such as "the," "a," or "an" are employed to describe elements and components of the embodiments herein; this is done merely for grammatical reasons and to conform to idiomatic English. This detailed description should be read to include one or at least one, and the singular also includes the plural unless it is clearly indicated otherwise.

Figure 1A:
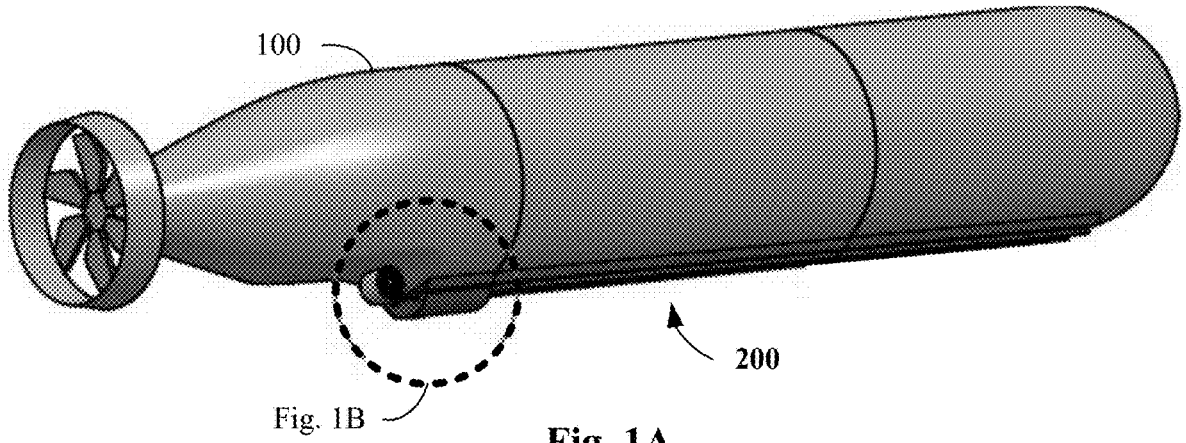
FIG. 1A is a perspective view of a submersible conveyance and an apparatus for inducing a submersible conveyance into a vertical dive.

FIG. 1A is a perspective view of a submersible conveyance 100 and an apparatus for inducing a submersible conveyance into a vertical dive 200. In one embodiment, the submersible conveyance 100 and the apparatus for inducing a submersible conveyance into a vertical dive 200 are both modular. The modular construction of the submersible conveyance 100 and the apparatus for inducing a submersible conveyance into a vertical dive 200 allows discrete each to separate into, interchangeable sections. Modularity has many benefits for deployment and manufacturing, but typically poses challenges with design and functionality. This disclosure describes an apparatus and system for inducing a direct vertical dive with a modular submersible conveyance 100.

The submersible conveyance 100 is a self-propelled aquatic vehicle for motion in any direction with a body of water surrounding the submersible conveyance 100. In one embodiment, the submersible conveyance 100 may be remotely operated either wirelessly or with a wired tether. This may be referred to as an unmanned underwater vehicle.

The apparatus for inducing a submersible conveyance into a vertical dive 200 may further comprise, consist of, or consist essentially of a track 210, belt 220, means for driving the belt, and shifting weight 240. The apparatus 200 may induce a vertical dive along a dive vector by selectively shifting the weight 240 to leveraged position along the slide path in the track 210, wherein the weight 240 provides sufficient force to induce a dive. This dive moment induced by the shifting weight 240 is related to its position along the track. In one position, the shifting weight 240 is balanced with the center of mass of the submersible conveyance 100 to provide a balancing moment, wherein the submersible conveyance 100 is balances along the horizontal plane to efficiently travel horizontally. This position may be referred to, herein, as the "neutral position" or "balance position". When not at the balance position, the shifting weight 240 provides a dive moment in along a dive vector. The magnitude of the dive moment is related to a distance along the track 210 that the shifting weight 240 has traveled from the location of a balancing moment. The applied moment may be defined as Moment=$M_s(X_3-X_1)+M_vX_2$, wherein $M_s$ is the mass of the shifting weight 240, $M_v$ is the mass of the submersible conveyance 100, $X_1$ is the horizontal distance between the submersible conveyance's 100 center of buoyancy and the shifting weight 240 (when at a balancing moment), $X_2$ is the horizontal distance between the submersible conveyance's 100 center of buoyancy and its center of mass, and $X_3$ is the horizontal distance between the shifting weight's 240 neutral position and its current position. In one embodiment, the dive vector is substantially parallel to a thrust vector, but is not so limited The apparatus for inducing a submersible conveyance into a vertical dive 200 provides many benefits, including providing a dive moment without impacting the buoyancy over the complete submersible system. Additionally, the apparatus 200 enables the submersible 100 to pitch downwards, from a horizontal trajectory, directly into a vertical dive. Then, once the desired depth is reached, the shifting weight 240 may return to the balance position to pitch the submersible 100 back upwards.

Figure 1B:
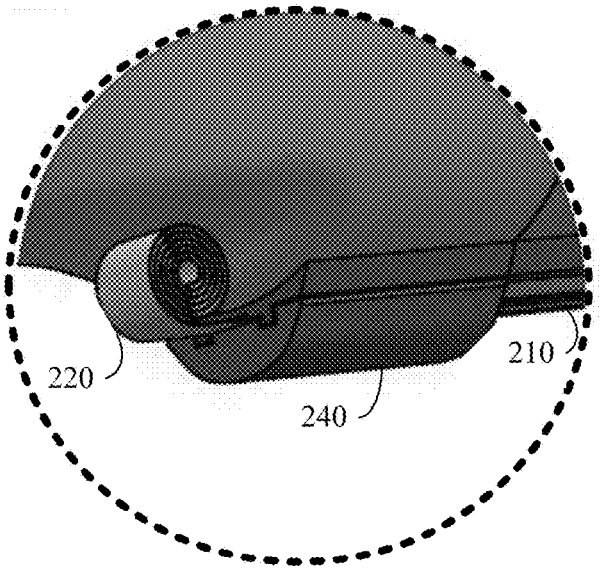
FIG. 1B is a close-up perspective view of FIG. 1A showing the apparatus for inducing a submersible conveyance into a vertical dive.

FIG. 1B is a close-up perspective view of FIG. 1A, as indicated by a dashed circle, showing the apparatus for inducing a submersible conveyance into a vertical dive 200 comprising a track 210, belt 220, and shifting weight 240. In one embodiment, the neutral position of the shifting weight may be at one end of the track 210, wherein that end is also adjacent to the belt 220 and belt drive (i.e. the proximal end). In another embodiment, a belt 220 is not a component of the apparatus for inducing a submersible conveyance into a vertical dive 200, because the shifting 240 weight is driven by an alternate mechanism. For example, the shifting weight 240 may be driven by a linear motor which interfaces between the shifting weight 240 and the track 210. As another example, the shifting weight 240 may be driven magnetically along the track 210, wherein electric coils spaced along the track 210 push/pull a shifting weight 240 coupled to a magnet.

The track 210 defines a slide path and is fixed to a submersible conveyance in alignment with a dive vector. Furthermore, the track 210 comprises a proximal end and a distal end, wherein the proximal end and distal end are at opposing ends of the track. In FIG. 1A, the shifting weight 240 is shown adjacent to the proximal end. In this embodiment, the shifting weight 240 is providing a balancing moment to the submersible conveyance 100, such that is optimized for horizontal travel. However, the proximal end of the track may not provide a balancing moment and instead provide a positive or negative dive moment. In one embodiment, the track 210 is fixed to the external hull of the submersible conveyance 100 as shown in the perspective view embodiment of FIG. 1A. The track 210 may be fixed anywhere along the submersible 100 in alignment with a vector that an operator wishes to induce a dive. Furthermore, there be a plurality of tracks 210 fixed to the submersible 100. For example, if there are sensors along the belly of the submersible 100, there could be two symmetrically positioned tracks 210 that runs along each side of the submersible 100. In another embodiment, the track 210 may be inside the submersible conveyance, but the slide path must be continuous (or modularly connectable) and non-pressurized.

The slide is a path for a weight 240 to traverse the submersible conveyance 210. The slide path may run the entire lengths of the track 210, from the proximal end to the distal end. In one embodiment, the slide path is a channel providing an interlocking coupling to the slide weight 240. In another embodiment, the slide path is a cavity slightly larger than the belt 220 configured to prevent the belt 220 from buckling. The track 210 may comprise any material that suits their purpose. In one embodiment, the track material is a rigid, waterproof material low density and sufficient strength. Moreover, the track 210 may be modular, in that it can be separated into distinct sections. As described previously, the tack 210 may be lined with electric coils to enable movement of a magnetized slide weight. Finally, the track 240 has a sufficient length to provide a dive moment, given the mass of the shifting weight 240, to induce a dive in the apparatus 200.

The belt 220 may be connected or coupled, at one end, to the shifting weight 240 and is configured to drive the shifting weight 240 along the track. The belt 220 may be made of metal, plastic, composite, or any material that allows it to push the weight forward and pull the weight back. Moreover, the belt 220 is non-buckling, meaning that it may either pull or push the shifting weight 240 along the track. In one embodiment, the belt is non-buckling it is a rope confined to a cavity only slightly larger in diameter than the rope. This allows the rope to be in tension or compression without buckling.

The belt 220 may be driven by several means. In one embodiment, the means for driving the belt 220 is a rotary actuator or motor. The rotatory actuator may be attached to the belt 220 and an axis of a belt coil, configured to feed the belt 220 into the track 210. In another embodiment, the belt 220 could be directly driven by wheels feeding the belt 220 into the track. In another embodiment, the belt 220 may be driven by a cylindrical drum feed. In another embodiment, the belt 220 may be driven by imbedded electrical conductors that provide power to a motor and drive wheels located adjacent to the shifting weight 240. In another embodiment, the belt 220 may have imbedded coils, and magnets placed adjacent to the slide weight, such that a linear motor directly moves the shifting weight 240. In another embodiment, the belt 220 may be driven by a rigid belt actuator, also known as a push-pull belt actuator or zipper belt actuator, is a specialized mechanical linear actuator used in push-pull and lift applications. The rigid belt actuator is a belt and pinion device that forms a telescoping beam or column member to transmit traction and thrust.

The shifting weight 240 may be operably engaged with the slide path to traverse between the proximal end of the track 210 and the distal end of the track 210. In some embodiments, the shifting weight 240 is coupled to one end of the belt. The shifting weight 240 may provide a balancing moment to the submersible conveyance when adjacent to the proximal end, and may induce a dive moment as the shifting weight 240 moves towards the distal end. The shifting weight has a mass sufficient to induce the submersible conveyance into a near vertical dive when adjacent to the distal end. The shifting weight 240 could be made of any material that suits their purpose. The optimum track material would have a low density and sufficient strength. In one embodiment, the slide weight is shaped to minimize its hydrodynamic drag.

Figure 2A:
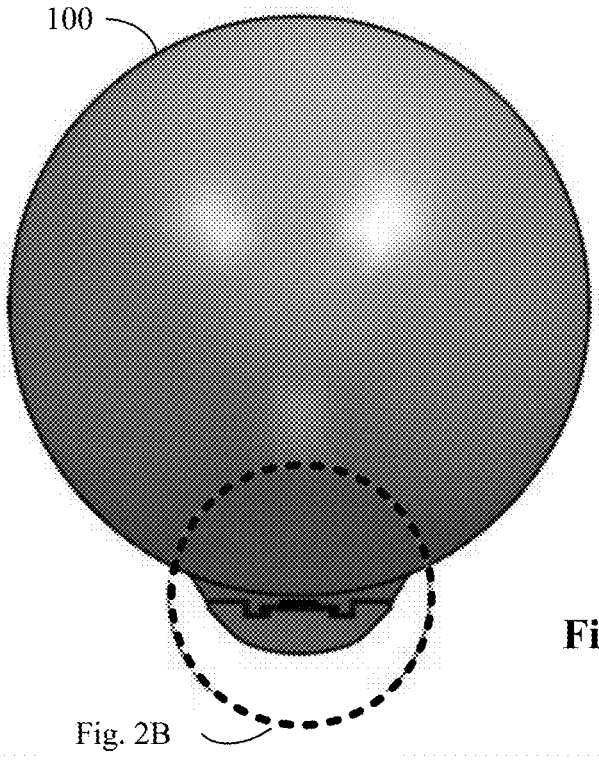
FIG. 2A is a front-view perspective of a submersible conveyance and an apparatus for inducing a submersible conveyance into a vertical dive.

FIG. 2A is a front-view perspective of a submersible conveyance 100 and an apparatus for inducing a submersible conveyance into a vertical dive 200. As shown in FIG. 2A, the apparatus for inducing a submersible conveyance into a vertical dive 200 may be on the underside of the submersible 100. However, this shown positioning is not required. A plurality of apparatuses for inducing a submersible conveyance into a vertical dive 200 may be externally connected to the hull of the submersible 100. Because the underside and top side are conveniently used for submersible sensors, these plurality of apparatuses for inducing a submersible conveyance into a vertical dive 200 may be symmetrically positioned on the sides to provide the desired dive inducing movement.

Figure 2B:
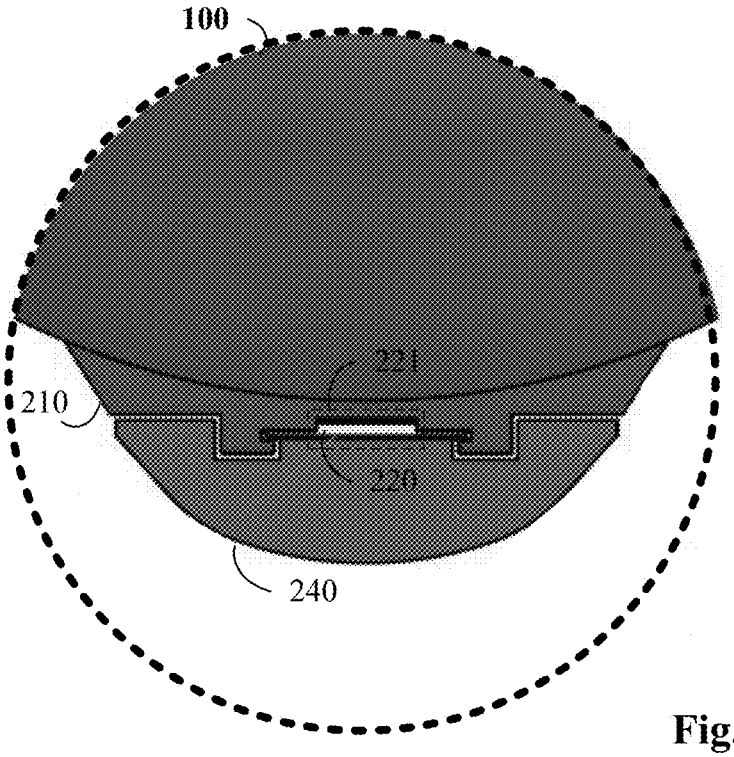
FIG. 2B is a front-view perspective of an apparatus for inducing a submersible conveyance into a vertical dive.

FIG. 2B is a front-view perspective of an apparatus for inducing a submersible conveyance into a vertical dive 200 comprising a track 210, belt 220, and shifting weight 240. As shown in FIG. 2B, the belt 220 may be constrained from buckling to provide tension and compression to the belt, which enables it to push and pull the shifting weight 240. This is shown by the belt 220 being tightly surrounded by the side path in the track.

Figure 3A:
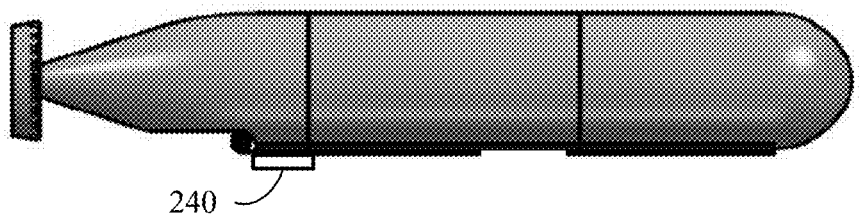
FIG. 3A is a perspective side-view of a submersible conveyance and an apparatus for inducing a submersible conveyance into a vertical dive.

FIG. 3A is a perspective side-view of a submersible conveyance 100 and an apparatus for inducing a submersible conveyance into a vertical dive 200 comprising a shifting weight 240. As show in FIG. 3B, the shifting weight 240 is in a neutral position providing a balancing moment to the submersible. This orientation of the submersible 100 is optimized for horizontal movement.

Figure 3B:
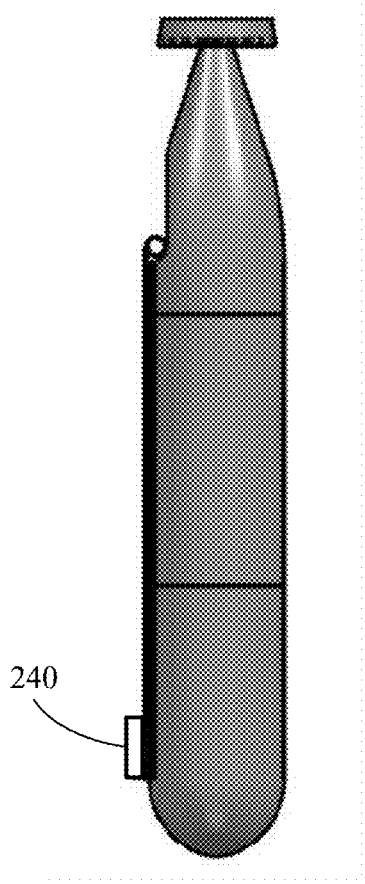
FIG. 3B is a perspective side-view of a submersible conveyance and an apparatus for inducing a submersible conveyance into a vertical dive.

FIG. 3B is a perspective side-view of a submersible conveyance 100 and an apparatus for inducing a submersible conveyance into a vertical dive 200 comprising a shifting weight 240 in a vertical (dive) position. As show in FIG. 3B, the shifting weight 240 is has moved from the neutral position in FIG. 3A, to a dive inducing position in 3B. It is important to reiterate that the dive moment is directly related to the shifting weight's distance from the balance position at the proximal end of the track 210 and continuously increases as it moves. Accordingly, the submersible 100 may achieve a near vertical dive before the shifting weight 240 reaches the position shown in FIG. 3B. Conversely, the shifting weight 240 may be at the distal end of the track 210 without the submersible 100 in a dive position. The shifting weight 240 has a sufficient weight to induce a near vertical dive moment.

Figure 4:
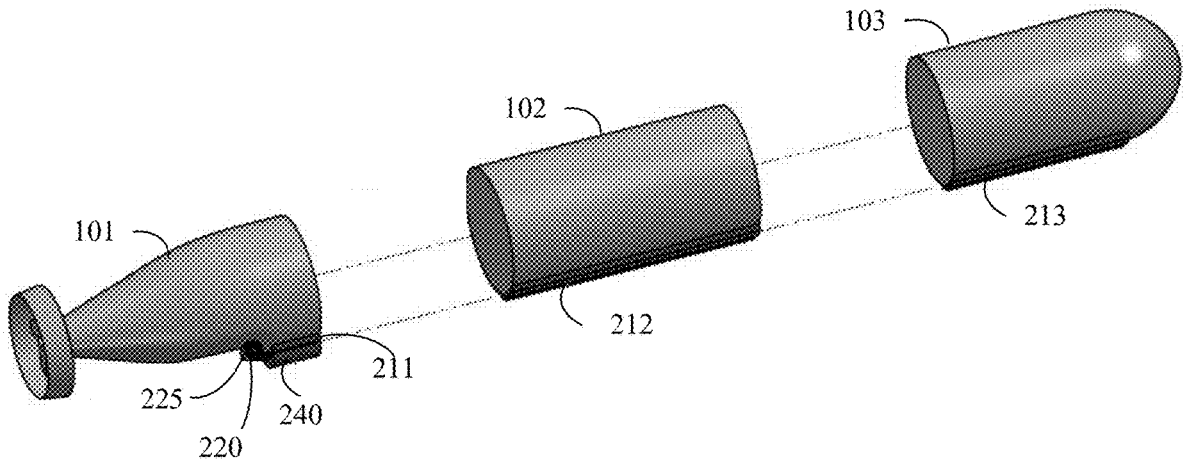
FIG. 4 is a perspective view of a modular submersible conveyance and a modular apparatus for inducing a submersible conveyance into a vertical dive.

FIG. 4 is a perspective view of a modular submersible conveyance 100 and a modular apparatus for inducing a submersible conveyance into a vertical dive 200. As shown in FIG. 4, the submersible 100 or apparatus 200 may be separated into discrete, modular pieces. The submersible conveyance may comprise a rear modular section 101, middle modular section 102, and a front modular section 103. Similarly, the apparatus for inducing a submersible conveyance into a vertical dive 200 may comprise a rear track 211, middle track 212, and a front track 213. As shown in FIG. 4, the rear track 211 may further comprise a belt coil and/or a means for driving the belt, as discussed herein.

From the above description of mass shifting apparatus and system for inducing a vertical dive in submersible conveyances, it is manifest that various techniques may be used for implementing the concepts of an apparatus for inducing a submersible conveyance into a vertical dive, a modular apparatus for inducing a submersible conveyance into a vertical dive, and a submersible conveyance for vertical dives without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that an apparatus for inducing a submersible conveyance into a vertical dive, a modular apparatus for inducing a submersible conveyance into a vertical dive, and a submersible conveyance for vertical dives without departing from the scope of the claims are not limited to the particular embodiments described herein, but is capable of many embodiments without departing from the scope of the claims.

What is claimed:

1. An apparatus for inducing a submersible conveyance into a vertical dive, comprising:

a track, having a proximal end and distal end, defining a slide path wherein the track is fixed to an external surface of a submersible conveyance in alignment with a dive vector; and a shifting weight operably engaged with the slide path to traverse between a proximal end and a distal end, wherein the shifting weight provides a balancing moment to the submersible conveyance when adjacent to the proximal end, and wherein driving the shifting weight towards the distal end provides dive moment to the submersible conveyance.

2. The apparatus for inducing a submersible conveyance into a vertical dive of claim 1, further comprising:

a belt coil adjacent the proximal end of the slide path for coiling the belt; and a constrained belt, having a proximal end and distal end, wherein the proximal end is connected to the belt coil and the distal end is connected to the shifting weight.

* * * * *